US007400221B2

(12) United States Patent
Kubo et al.

(10) Patent No.: US 7,400,221 B2
(45) Date of Patent: Jul. 15, 2008

(54) SEMI-COAXIAL CAVITY RESONATOR, FILTER USING THE SAME, AND COMMUNICATION APPARATUS USING THE SAME

(75) Inventors: Hiroyuki Kubo, Kusatsu (JP); Hirokazu Nakae, Kameoka (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 11/555,465

(22) Filed: Nov. 1, 2006

(65) Prior Publication Data

US 2007/0057747 A1 Mar. 15, 2007

Related U.S. Application Data

(63) Continuation of application No. PCT/JP2005/021345, filed on Nov. 21, 2005.

(30) Foreign Application Priority Data

Jan. 7, 2005 (JP) ..... 2005-003181

(51) Int. Cl.
*H01P 1/202* (2006.01)
*H01P 7/04* (2006.01)

(52) U.S. Cl. ..... 333/206; 333/134; 333/222

(58) Field of Classification Search ..... 333/202, 333/203, 206, 222, 229, 234, 134; 403/342, 403/343; 411/411, 424
See application file for complete search history.

(56) References Cited

U.S. PATENT DOCUMENTS 3,612,586 A * 10/1971 Stieber et al. ..... 403/296
4,191,486 A * 3/1980 Pelton ..... 403/28
4,890,078 A * 12/1989 Radcliffe ..... 333/134
4,934,859 A * 6/1990 Dixon et al. ..... 403/274
5,304,962 A * 4/1994 Bobadilla et al. ..... 333/134
5,543,758 A * 8/1996 Wey ..... 333/203

FOREIGN PATENT DOCUMENTS

| | | |
|---|---|---|
| JP | 55-115612 | 9/1980 |
| JP | 62-32701 | 2/1987 |
| JP | 2001-027214 | 1/2001 |
| JP | 2001-075555 | 3/2001 |
| JP | 2003-13930 | 1/2003 |
| JP | 2002-286012 | 10/2003 |
| JP | 2004-254085 | 9/2004 |

OTHER PUBLICATIONS

Written Opinion International Search Report issued Jan. 24, 2006.

* cited by examiner

*Primary Examiner*—Seungsook Ham
(74) *Attorney, Agent, or Firm*—Ostrolenk, Faber, Gerb & Soffen, LLP

(57) ABSTRACT

In a semi-coaxial cavity resonator in which an inner conductor is fixed to an outer conductor with a screw, an inner cavity where the inner conductor does not engage with the screw is provided to extend from a bearing surface of the inner conductor to a region of an internal thread hole formed inside the inner conductor which does engage with the screw, thereby providing a region where the screw is deformable. Accordingly, deviation in perpendicularity of the screw relative to the bearing surface, deviation in perpendicularity of the internal thread hole of the inner conductor, and the like, may be accommodated by the deformation of the screw, and the bearing surface of the inner conductor is brought into contact with a bottom surface of an outer conductor evenly and reliably, thereby suppressing intermodulation distortion from occurring.

10 Claims, 9 Drawing Sheets

SEMI-COAXIAL CAVITY RESONATOR, FILTER USING THE SAME, AND COMMUNICATION APPARATUS USING THE SAME

CROSS-REFERENCE TO RELATED APPLICATIONS

This is a continuation of PCT/JP2005/021345 filed Nov. 21, 2005, incorporated by reference.

BACKGROUND OF THE INVENTION

1. Technical Field

The present invention relates to a semi-coaxial cavity resonator, a filter using it, and a communication apparatus using it.

2. Background Art

Conventionally in use are a semi-coaxial cavity resonator having a casing comprising an integrally formed outer conductor and inner conductor made of aluminum or an aluminum alloy, and a filter using the semi-coaxial cavity resonator. The resonator and the filter are formed by machining or die casting, and each has a closed space arranged inside thereof by fixing with screws a panel provided with an adjusting screw, so that this may function as a resonator or a filter. The material of the resonator and the filter is not limited to being aluminum or an aluminum alloy, and especially when being formed by machining, various materials are applicable, such as Invar, copper, a copper alloy, or iron. Generally, the material is used after it is processed with surface treatment by plating or the like. An exemplary structure of such filter is disclosed in Patent Document 1, Japanese Unexamined Patent Application Publication No. 2001-24404.

FIG. 1 is a semi-coaxial cavity resonator according to a conventional example. FIG. 1(*a*) is a plan view showing a semi-coaxial cavity resonator with an upper panel thereof removed, and FIG. 1(*b*) is a cross sectional view taken along a line B-B. An inner conductor 31 is integrally formed in a casing 32, on a bottom surface 32*b* and inside an outer conductor 32*a*.

In a filter using the semi-coaxial cavity resonator having the integrally formed outer conductor and inner conductor made of aluminum or an aluminum alloy, a coefficient of linear expansion of the material is large, and accordingly, frequency variation with temperature is large. In particular, in a filter in which a dielectric resonator and a semi-coaxial cavity resonator are combined, since the frequency variation with temperature of the dielectric resonator is extremely small, the frequency response of the filter may be disordered unless the frequency variation with temperature of the semi-coaxial cavity resonator is reduced. Using an Invar material to form a part of the semi-coaxial cavity resonator may provide a filter causing almost no frequency variation with temperature, however, the manufacturing cost and the weight of the semi-coaxial cavity resonator may increase. To solve such problems, Patent Document 2, Japanese Unexamined Patent Application Publication No. 2004-254085, discloses an example of a filter in which variation in characteristics due to the variation in temperature, is reduced, by using aluminum for forming a casing which defines an outer conductor, and by using an iron material or an Invar alloy for forming an inner conductor of a semi-coaxial cavity resonator.

As described above, when a metal having a relatively small coefficient of linear expansion is used for the inner conductor, in relation to an aluminum casing, which is the outer conductor, a semi-coaxial cavity resonator having extremely small variation with temperature may be provided by optimizing the length of the inner conductor. In this configuration, since the inner conductor and the outer conductor are made of different metals, the inner conductor and the outer conductor must be formed separately, and each of these is processed with a predetermined surface treatment, and then the inner conductor must be attached to the outer conductor.

Since a portion where the inner conductor is attached to the outer conductor is a region to which the highest current is applied in the semi-coaxial cavity resonator, if the electrical contact at that region is partially defective, large intermodulation distortion may occur.

The intermodulation distortion occurs when variation in voltage and variation in current plot non-linear forms locally in the device. Generally, this may occur when a surface condition of a conductor to which high current is applied is poor, when the conductor has a sharp edge, or when a defect is present at a contact portion of the conductors. The defect present at the contact portion of the conductors to which the high current is applied is the most critical factor for causing the large intermodulation distortion to occur.

In order to suppress the occurrence of the intermodulation distortion in the semi-coaxial cavity resonator in which the inner conductor is fixed to the outer conductor with a screw, the outer circumference of a fixing portion of the inner conductor is fixed to the outer conductor with an evenly applied, tight axial tension, and electrically smooth contact is secured over the outer circumference.

As a way of attaching the inner conductor to the outer conductor reliably and tightly, a fixture using a screw is the most appropriate and the cheapest, with the least worker-hours. FIG. 2 is a cross sectional view of a fixing portion of an inner conductor and an outer conductor of a semi-coaxial cavity resonator, in which the inner conductor and the outer conductor are separately formed, according to a conventional example. An inner conductor 19 is fixed at a bottom surface 3*a* of an outer conductor 3 with a screw 2. In this example, because of various factors, such as perpendicularity of the central axis of an internal thread provided at the inner conductor relative to a bearing surface 20, perpendicularity of the screw 2, and parallelism of the bottom surface 3*a* of the outer conductor 3 relative to a bearing surface of the screw, the intensity distribution of the contact portion between the bearing surface 20 of the inner conductor and the bottom surface 3*a* of the outer conductor 3 may result in non-uniformity after the inner conductor is fixed with the screw. Accordingly, even though the bearing surface 20 seems to be in contact with the bottom surface 3*a*, a part of the contact portion may not achieve the electrically smooth contact state, thereby causing the large intermodulation distortion to occur.

SUMMARY OF THE INVENTION

To address the above-described problems, a semi-coaxial resonator according to an embodiment of the present invention may be configured as follows.

According to a first aspect of the invention, a semi-coaxial cavity resonator may include: an outer conductor having a cavity therein; and a columnar inner conductor fixed at a bottom surface of the cavity, but not fixed at a surface facing the bottom surface of the cavity. The inner conductor has a hole therein with an internal thread being formed at the hole, and is fixed at the bottom surface of the outer conductor with a screw, a surface roughness (Ra) of each of a contact surface of the inner conductor and that of the outer conductor is equal to or less than 1.6 μm, $(5T/d)/S \geqq 60$ (MPa) is established, where T (N·m) is a tightening torque of the screw, d (m) is a diameter of the screw, and S ($m^2$) is an area of the contact surface,the hole of the inner conductor has a cavity that is not engaged with the screw, at a region directly above the bottom surface of the outer conductor, and a height of the cavity is equal to or more than a radius of the screw, and a length of a portion of the screw being engaged with the internal thread is equal to or less than twice the diameter of the screw.

According to a second aspect of the invention, a semi-coaxial cavity resonator may include: an outer conductor having a cavity therein; and a columnar inner conductor fixed at a bottom surface of the cavity, but not fixed at a surface facing the bottom surface of the cavity. The inner conductor has a hole therein with an internal thread being formed at the hole, and is fixed at the bottom surface of the outer conductor with a screw, a surface roughness (Ra) of each of a contact surface of the inner conductor and that of the outer conductor is equal to or less than 1.6 μm, $(5T/d)/S \geqq 60$ (MPa) is established, where T (N·m) is a tightening torque of the screw, d (m) is a diameter of the screw, and S ($m^2$) is an area of the contact surface, the screw has an unthreaded portion that is not engaged with the internal thread of the inner conductor, at a region directly above a bearing surface of the outer conductor, and a diameter of the unthreaded portion is equal to or less than a minor diameter of an external thread, and a length of the unthreaded portion is equal to or more than the radius of the screw, and a length of a portion of the screw being engaged with the internal thread is equal to or less than twice the diameter of the screw.

On the basis of the foregoing aspects of the invention, according to a third aspect of the invention, in terms of the profile of the bottom surface at a portion where the columnar inner conductor is fixed at the bottom surface of the cavity with the screw, that portion may be projected from the bottom surface and extend over the entire circumference of a surface that is in contact with the columnar inner conductor, and the projecting portion may be rounded at the entire outer circumference of the projecting portion continuously arranged in contact with the bottom surface.

On the basis of the foregoing aspects of the invention according to a fourth aspect of the invention, the outer conductor is made of aluminum, or an aluminum alloy, and the inner conductor is made of stainless steel.

According to a fifth aspect of the invention, a band pass filter may include: a plurality of the semi-coaxial cavity resonators according to any one of the foregoing aspects of the invention, the semi-coaxial cavity resonators being continuously arranged; and input/output connectors; and a slit having a predetermined size is provided at a partition that is disposed between the adjacent semi-coaxial cavity resonators for inter-stage coupling of the semi-coaxial cavity resonators.

According to a sixth aspect of the invention, a band elimination filter may include: a plurality of the semi-coaxial cavity resonators according to any one of the foregoing aspects of the invention, the semi-coaxial cavity resonators being continuously arranged; and coupling units that allow the semi-coaxial cavity resonators to be coupled to a transmission line, the transmission line being provided with input/output connectors.

According to a seventh aspect of the invention, a duplexer may include: at least two filters, and an antenna connector that is connected to the filters in a shared manner, in which at least one of the filters is the band pass filter according to the fifth aspect of the invention.

According to an eighth aspect of the invention, a communication apparatus may include: the duplexer according to the seventh aspect of the invention; a transmission circuit that is connected to at least one of the input/output connectors of the duplexer; and a reception circuit that is connected to another of the input/output connectors; and optionally an antenna that is connected to the antenna connector of the duplexer.

According to one or more of the foregoing aspects of the invention, there is provided a portion where the internal thread of the inner conductor and the external thread of the screw are not engaged with each other, in the inner conductor at a region directly above the surface where the bearing surface of the inner conductor and the bottom surface of the outer conductor are fixed together. Therefore, a length of a portion allowing the screw to be deformable may be increased.

When the central axis of the internal thread of the inner conductor is not completely perpendicular to the bearing surface of the inner conductor, when the bottom surface of the outer conductor is not completely parallel to the bearing surface of the screw, or when the bearing surface of the screw is not completely perpendicular to the central axis of the screw, the bearing surface of the inner conductor may be slightly inclined relative to the bottom surface of the outer conductor, however, this slight inclination may be accommodated due to the deformation of the screw. Accordingly, deviation in the contact intensity distribution may be reduced at the portion where the bearing surface of the inner conductor and the bottom surface of the outer conductor are fixed together. In addition, by setting the surface roughness (Ra) of each of the bearing surface of the inner conductor and the bottom surface of the outer conductor to 1.6 μm or less, and then by setting the torque of the screw such that the contact pressure becomes 60 MPa or higher, the entire circumference of the inner conductor may come into contact with the outer conductor substantially by an evenly applied tension. Therefore, the electrically smooth contact may be provided and the occurrence of the intermodulation distortion may be suppressed.

DETAILED DESCRIPTION OF EMBODIMENTS OF THE INVENTION

First Embodiment

Figure 1A:
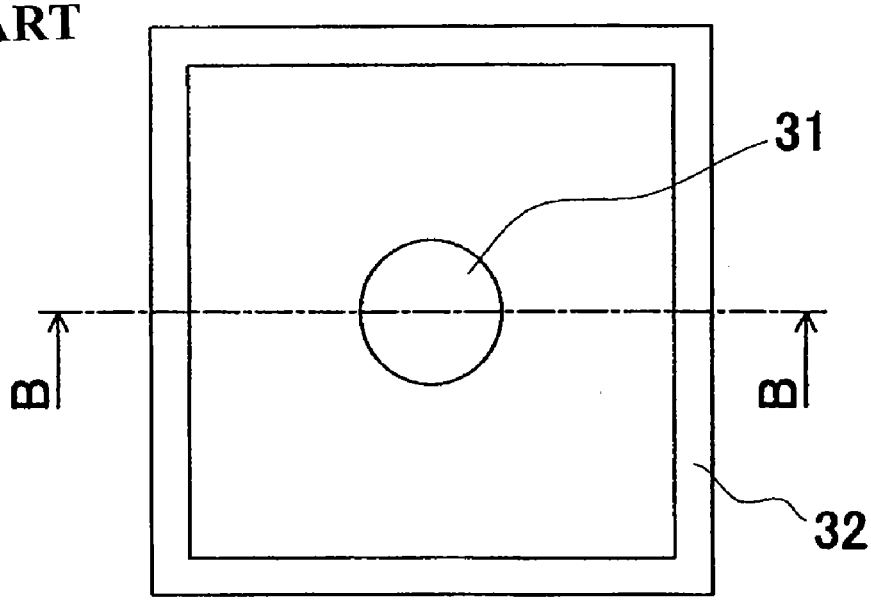
FIG. 1(a) PRIOR ART
FIG. 1 is an explanatory view showing a semi-coaxial resonator in which an inner conductor and an outer conductor are integrally formed according to a conventional example.
Figure 1B:
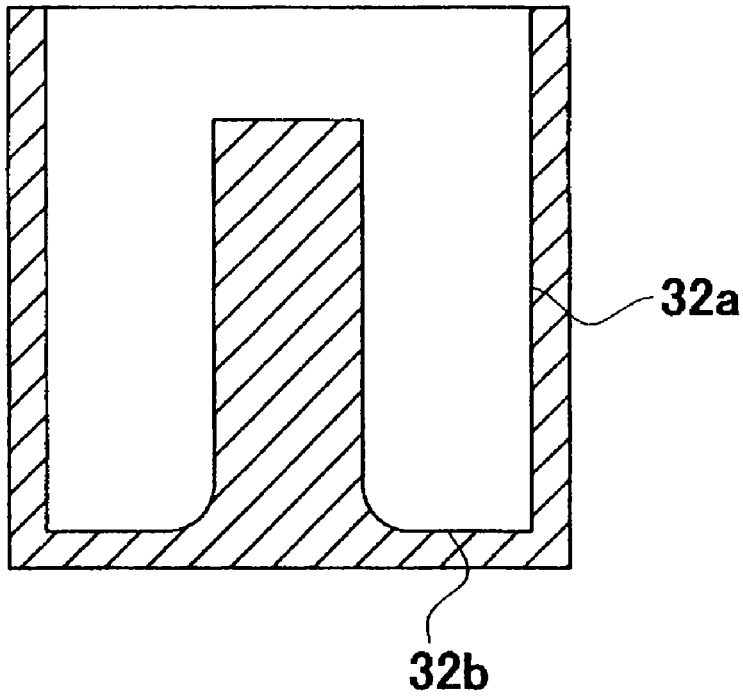
FIG. 1(b) PRIOR ART
Figure 2:
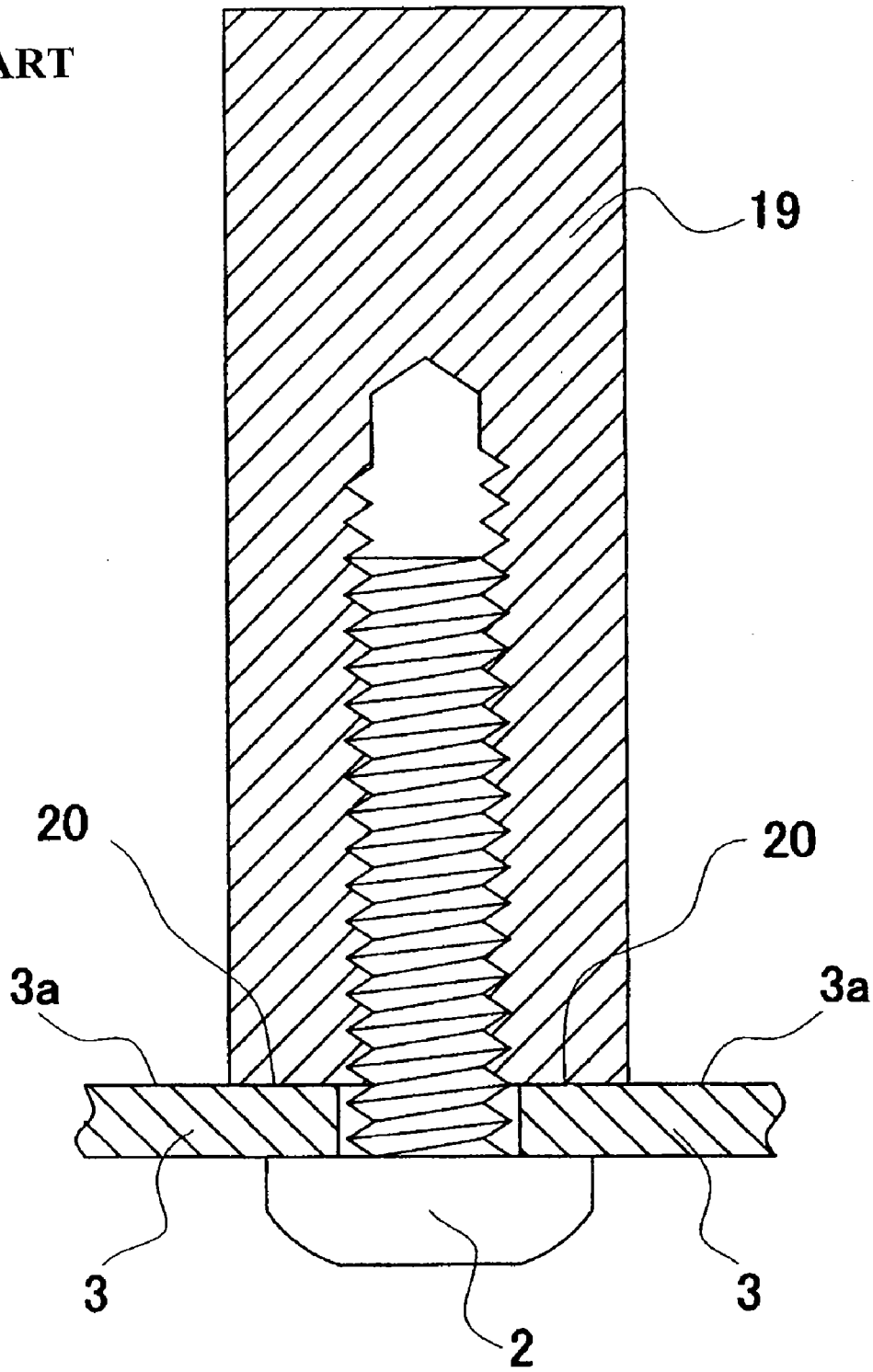
FIG. 2 PRIOR ART
FIG. 2 is a vertical cross-sectional view taken along the center line of a fixing portion of the inner conductor in the conventional semi-coaxial cavity resonator.
Figure 3:
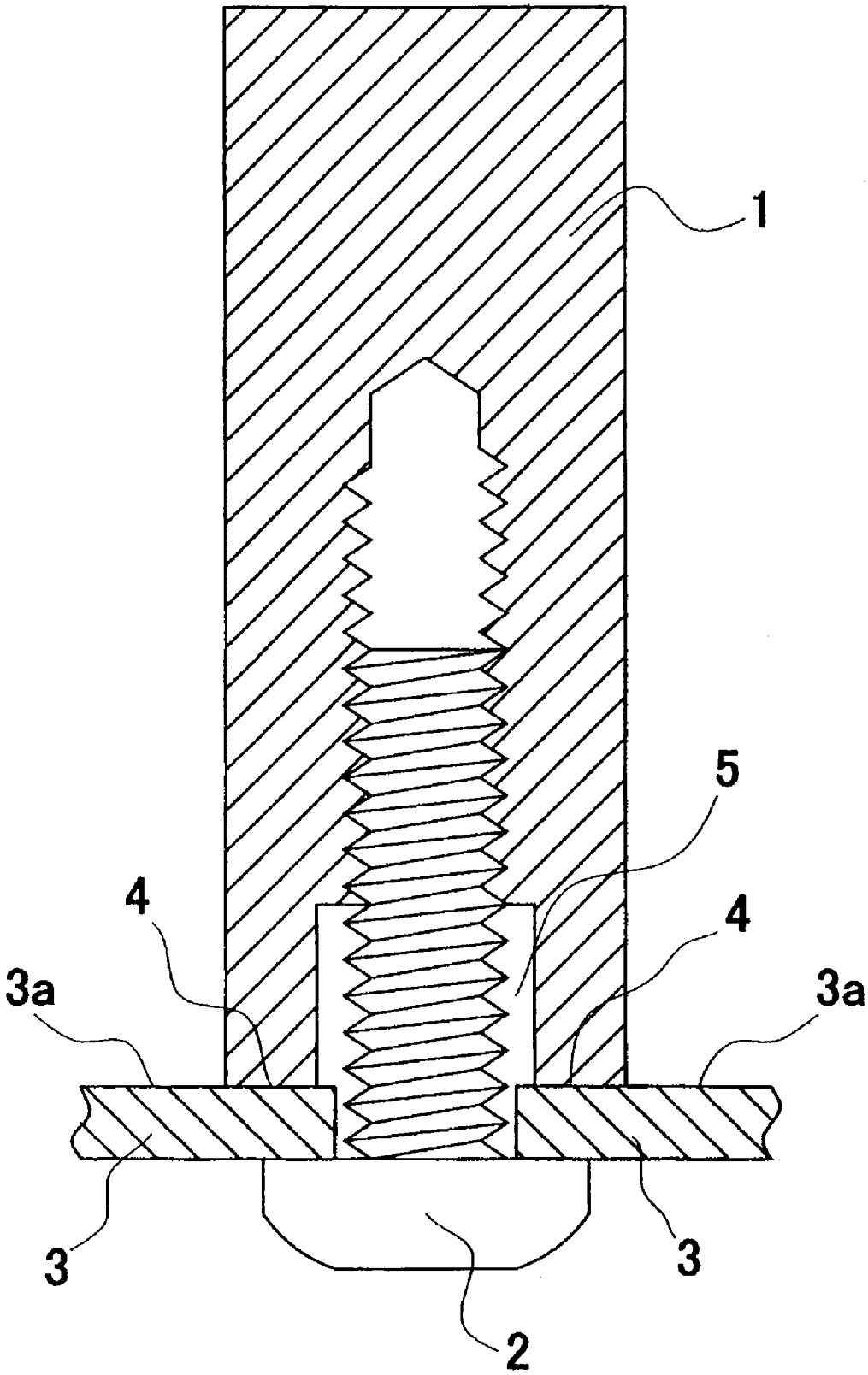
FIG. 3 is a vertical cross-sectional view taken along the center line of a fixing portion of an inner conductor in a semi-coaxial cavity resonator according to a first embodiment of the present invention.
Figure 4A:
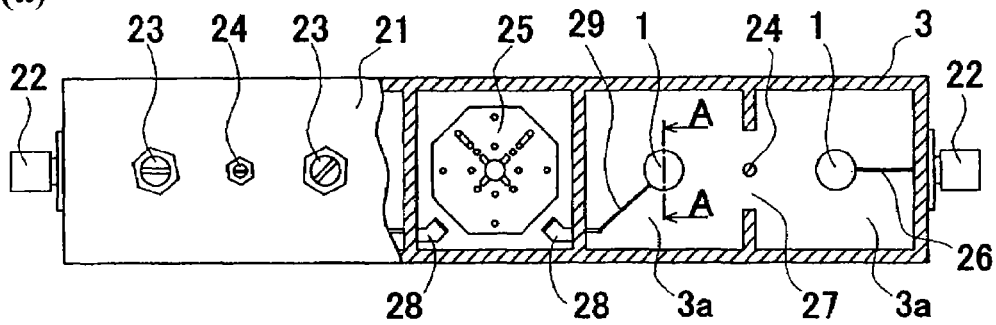
FIG. 4 is an illustration showing a configuration of a band pass filter using the semi-coaxial cavity resonators.
Figure 4B:
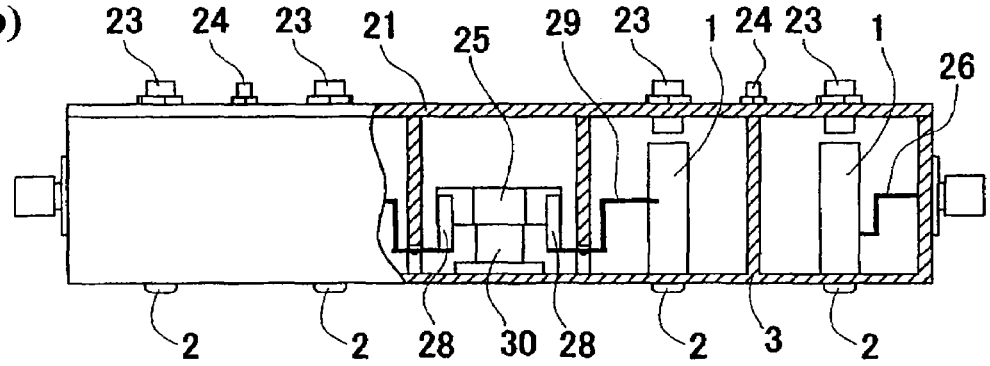

FIG. 3 is a cross sectional view showing a fixing portion of an inner conductor according to a first embodiment of the present invention, and is a partial view taken along a line A-A of a filter using a semi-coaxial cavity resonator as shown in FIG. 4.

First, FIG. 4 is described. FIG. 4(*a*) is a plan view showing a band pass filter in which a semi-coaxial cavity resonator and a dielectric resonator are combined, and shows the inside of the filter with a part of an upper conductor panel 21 eliminated. FIG. 4(*b*) is a lateral view of FIG. 4(*a*), and shows the inside of the filter with a part of a lateral surface of an outer conductor 3 eliminated.

The outer conductor 3 has a hollow structure with a surface being opened, and the hollow structure is divided by partitions into cavities. An inner conductor 1 is fixed at the bottom surface 3*a* of the outer conductor 3 with a screw 2. This will be described later in detail with reference to FIG. 3. The inner conductor 1 is not fixed at the undersurface of the upper conductor panel 21 which faces the bottom surface 3*a* of the outer conductor 3. A frequency-adjusting screw 23 made from a conductor is screwed through the upper conductor panel 21 at a region directly above the inner conductor 1, thereby forming each of the semi-coaxial cavity resonators.

A slit 27 is provided at the partition of the adjacent semi-coaxial cavity resonators to achieve electromagnetic field coupling between the adjacent resonators. The opening of the slit 27 is extended to an upper end surface of the outer conductor 3. In addition, a coupling-adjusting screw 24 made from a conductor is screwed through the upper conductor panel 21 and projects into the slit 27 to adjust the degree of the electromagnetic field coupling to a desired value.

A dielectric resonator 25 having a support base 30 made of a low dielectric constant material is dispose is the located at center of the outer conductor 3. The support base 30 is attached to the dielectric resonator 25, and fixed at the outer conductor 3 with a screw. The electromagnetic field occurring at the dielectric resonator 25 is coupled to the adjacent semi-coaxial cavity resonators via coupling probes 28 and coupling leads 29. Incidentally, the dielectric resonator 25 is configured to be triple mode, whereby the filter functions as a 7-stage band pass filter. The degree of multiplexing and the number of dielectric resonators 25 installed, or the number of semi-coaxial cavity resonators installed, may be appropriately determined in accordance with desired characteristics.

Input/output leads 26 are attached to the inner conductors 1 disposed in the first and last stages of the semi-coaxial cavity resonators, and are connected to input/output connectors 22.

Referring back to FIG. 3, the details of the fixing portion of the inner conductor 1 and the outer conductor 3 are described. The inner conductor 1 is a metal column having a hole inside, and an internal thread is formed in the hole. The inner conductor 1 may be a cylinder, an elliptical cylinder, or a polygonal prism. Preferably, it is a cylinder for securing stable contact, and it is preferable that the central axis of the inner conductor relative to the outer circumference coincides with the central axis of the hole provided inside the inner conductor.

The inner conductor 1 is treated by plating if necessary, and the plating is preferably similar to that of the outer conductor. In particular, silver plating or copper plating is preferable to suppress intermodulation distortion effectively. Further, if plating with a magnetic material such as Ni is applied to the base of the plating, or if the base material is a magnetic material, it is preferable for the thickness of the plating of the outer layer to be 3δ or more when the skin effect at high frequency is assumed as δ. The plating at the outer layer may have a multi-layer structure. Herein, δ is obtained by $\delta=(\pi f\sigma\mu)^{-1/2}$, where σ(/Ωm) is a conductivity of the plating metal in the outer layer, and μ is a permeability of the plating metal in the outer layer.

The inner conductor 1 has an inner cavity 5, which is formed by removing or chipping off the internal thread formed in the inner conductor 1. The height of the inner cavity 5 from a bearing surface 4 of the inner conductor 1 is preferably equal to or more than a radius of the screw 2. Note that the radius of the screw 2 is defined as a half of a major diameter of the screw (outer diameter at the threaded portion).

The inner conductor 1 is fixed at the bottom surface 3*a* of the outer conductor 3 with the screw 2, so that the bearing surface 4 of the inner conductor 1 electrically comes into contact with the bottom surface 3*a* of the outer conductor 3. The screw 2 is not engaged with the inner conductor 1 at the inner cavity 5 region, and hence, the screw 2 is deformable at this region.

The length of a portion of the screw 2 being engaged with the internal thread of the inner conductor 1 is preferably equal to or less than twice a diameter of the screw. The greater the height of the inner cavity 5 is, the greater the length of the deformable region of the screw 2 becomes, and the more the uniformity of the contact pressure acting between the bearing surface 4 of the inner conductor and the bottom surface 3*a* of the outer conductor 3 becomes.

Second Embodiment

Figure 5:
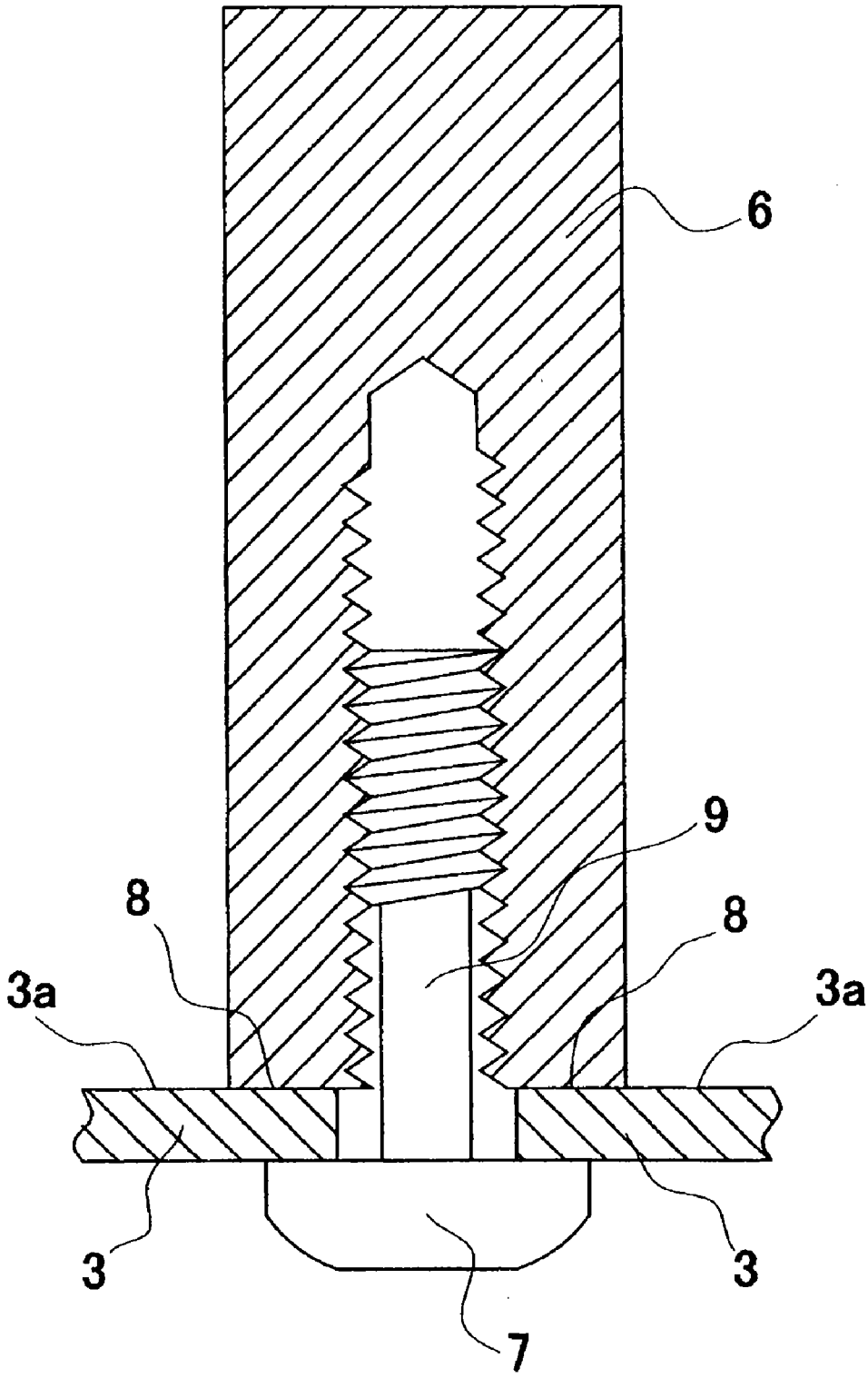
FIG. 5 is a vertical cross-sectional view taken along the center line of a fixing portion of an inner conductor in a semi-coaxial cavity resonator according to a second embodiment of the present invention.

FIG. 5 is a cross sectional view showing a fixing portion of an inner conductor according to a second embodiment of the present invention. Parts different from the first embodiment are mainly described here. An inner conductor 6 has a structure substantially similar to that of the inner conductor 1 according to the first embodiment, except that the inner conductor 6 does not have the inner cavity 5.

The screw 7 has an unthreaded portion 9 having a predetermined length from a screw head. The diameter of the unthreaded portion 9 is equal to or less than a minor diameter of the external thread (the smaller diameter taken between the threads). The length of the unthreaded portion 9, when the thickness of the outer conductor 3 is not taken into account, is preferably equal to or more than a radius of the screw 7. Note that the radius of the screw 7 is defined as a half of a major diameter of the screw.

The inner conductor 6 is fixed at the bottom surface 3*a* of the outer conductor 3 with the screw 7, so that a bearing surface 8 of the inner conductor 6 electrically comes into contact with the bottom surface 3*a* of the outer conductor 3. The unthreaded portion 9 is not engaged with the inner conductor, and hence, the screw 7 is deformable in this region.

This delivers advantages similar to that of the first embodiment. The length of a portion of the screw 7 being engaged with the internal thread of the inner conductor 6 is preferably equal to or less than twice the diameter of the screw 7. The longer the length of the unthreaded portion 9 is, the longer the length of the deformable region of the screw 7 becomes, and the greater the uniformity of the contact pressure acted between the bearing surface 8 of the inner conductor and the bottom surface 3*a* of the outer conductor 3 becomes.

Third Embodiment

Figure 6:
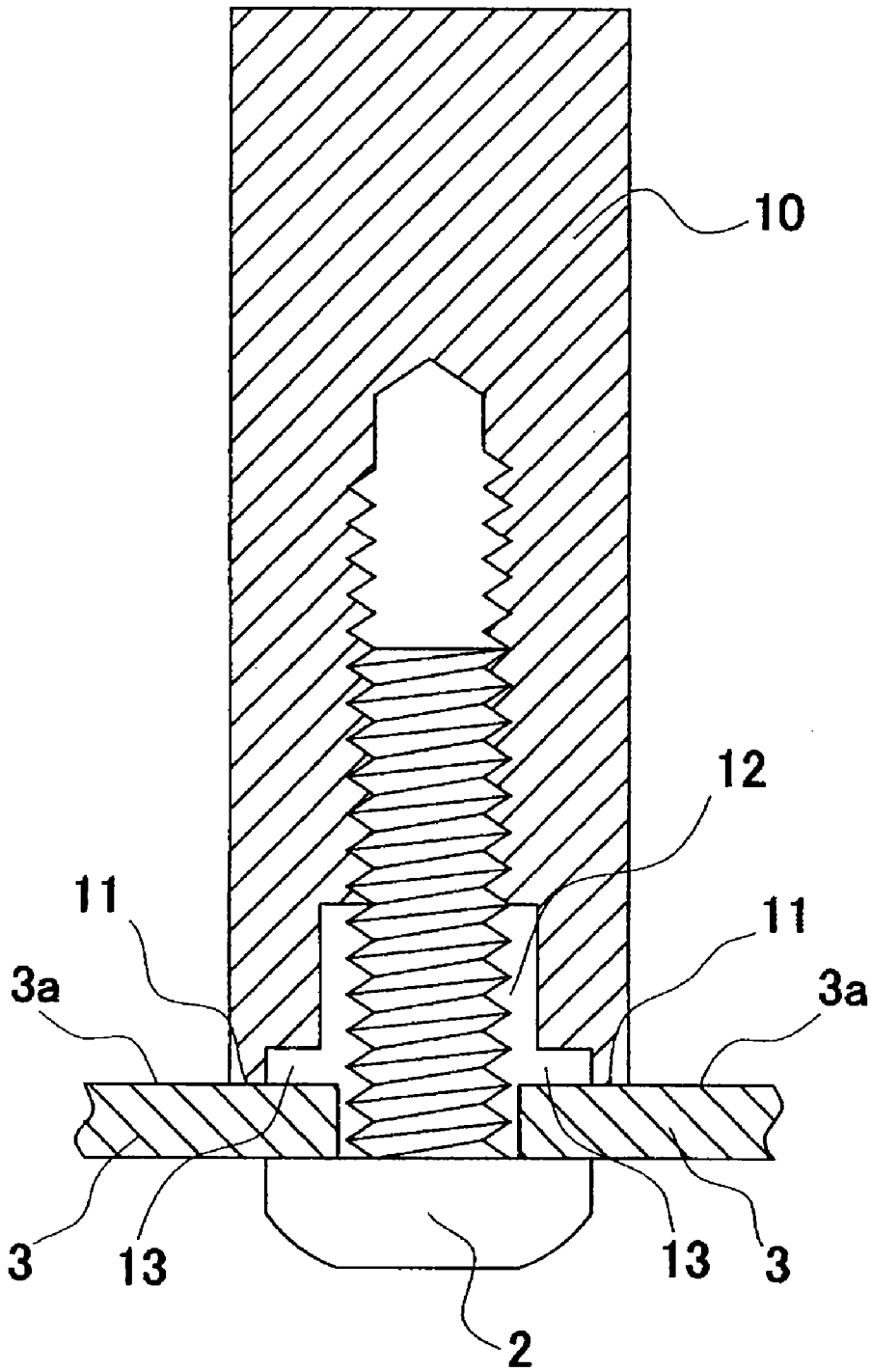
FIG. 6 is a vertical cross-sectional view taken along the center line of a fixing portion of an inner conductor in a semi-coaxial cavity resonator according to a third embodiment of the present invention.

FIG. 6 is a cross sectional view showing a fixing portion of the inner conductor according to a third embodiment of the present invention. Parts different from the first embodiment are mainly described here. An inner conductor 10 has a cavity 12 which is not engaged with the screw 2, similarly to the inner conductor 1 according to the first embodiment, and also has a recess 13 with a diameter larger than that of the cavity 12. The total height of the inner cavity 12 and the recess 13 from the bearing surface 4 of the inner conductor 10 is preferably equal to or more than the radius of the screw 2. Note that the radius of the screw 2 is defined as half of the major diameter of the screw.

The inner conductor 10 is fixed at the bottom surface 3*a* of the outer conductor 3 with the screw 2, so that a bearing surface 11 of the inner conductor 10 electrically comes into contact with the bottom surface 3*a* of the outer conductor 3.

The provision of the recess 13 causes an area of the bearing surface 11 of the inner conductor 10 to be reduced, thereby increasing the contact pressure. This has the combined advantages of making the distribution of the contact pressure more uniform, and increasing the contact pressure, and this combination further enhances the advantage of suppressing the intermodulation distortion.

Fourth Embodiment

Figure 7:
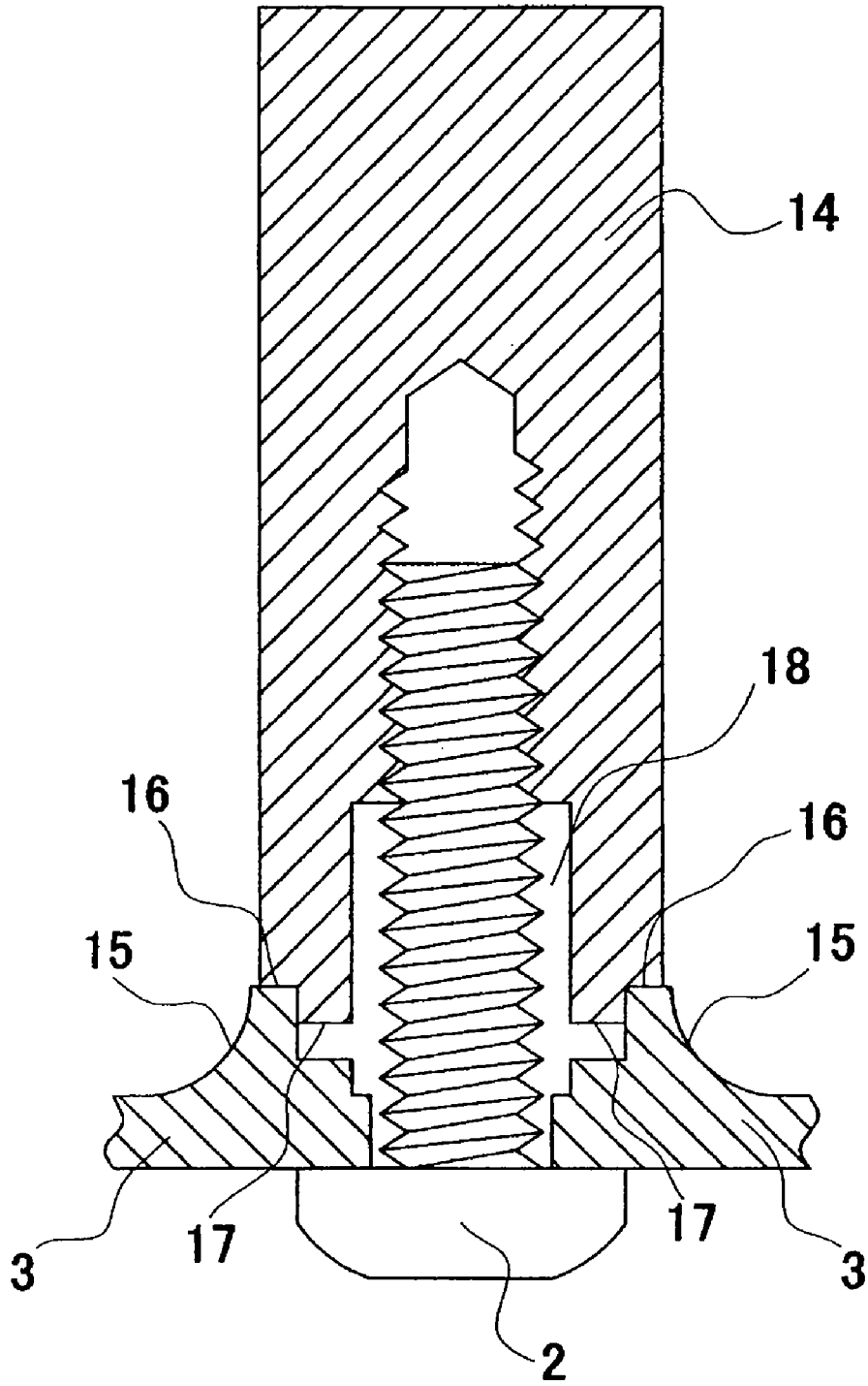
FIG. 7 is a vertical cross-sectional view taken along the center line of a fixing portion of an inner conductor in a semi-coaxial cavity resonator according to a fourth embodiment of the present invention.

FIG. 7 is a cross sectional view showing a fixing portion of an inner conductor according to a fourth embodiment of the present invention. Parts different from the first embodiment are mainly described here. An inner conductor 14 has an inner cavity 18 which is not engaged with the screw 2, similarly to the inner conductor 1 according to the first embodiment, and also has a projection 17 to be fitted with a recess provided at a bulged portion 15 arranged at the bottom surface of the outer conductor 3. The height of the inner cavity 18 from a bearing surface 16 of the inner conductor 14 is preferably equal to or more than the radius of the screw 2. Note that the radius of the screw 2 is half of the major diameter of the screw.

The inner conductor 14 is fixed, with the screw 2, at the bulged portion 15 arranged at the bottom surface of the outer conductor 3, so that the bearing surface 16 of the inner conductor electrically comes into contact with the bulged portion 15 of the outer conductor.

With this embodiment, since the recess provided by the bulged portion 15 of the bottom surface of the outer conductor, is fitted with the projection 17 provided on the inner conductor 14, the position of the inner conductor 14 can be determined relative to the outer conductor 3. Accordingly, shaking of the inner conductor 14 in the middle of tightening the screw 2 may be suppressed, thereby preventing the inner conductor 14 from being deteriorated due to friction occurring between the contact surfaces. Therefore, the contact state after the screw 2 is tightened becomes more reliable as compared with the first to third embodiments.

Further, since the bulged portion 15 is provided, no joint is present between the conductors to which the highest current is applied during the resonant operation of the semi-coaxial cavity resonator. Therefore, the occurrence of the intermodulation distortion may be further effectively suppressed.

In the above-described embodiments, it has been verified by the inventors according to experiments that the occurrence of the intermodulation distortion can be suppressed at this portion as long as the surface roughness (Ra) of each of the contact surfaces of the inner conductor and that of the outer conductor is 1.6 μm or less, and the pressure applied to the contact portion due to the force of the screw is 60 MPa or higher. However, if the contact pressure is too high, plastic deformation may occur in the material, and may cause a contact failure. Owing to this, the contact pressure should preferably be a predetermined value with regard to the plastic deformation capability of the material.

Here, $P=(5T/d)/S$ is established, where P (Pa) is the contact pressure, T (N·m) is a tightening torque of the screw, d (m) is a diameter of the screw and S ($m^2$) is a contact area. T, d, and S are appropriately set to predetermined values such that P is 60 MPa or higher, but does not exceed the plastic deformation capability of the bearing surface of the inner conductor and that of the bottom surface of the outer diameter.

For example, describing this in the case of the third embodiment, $S=2.83\times10^{-5}$ ($m^2$) is established, where an outer diameter of the inner conductor 10 is 10 (mm), and an inner diameter of the recess 13 is 8 (mm). Assuming that the inner conductor is made of stainless steel and the outer conductor is made of aluminum, the plastic deformation capacity of aluminum is smaller than that of the stainless steel. Since the plastic deformation capacity of the aluminum is 115 MPa, when the screw 2 of M5 steel is used, the tightening torque T of the screw 2 is set to be $1.70<T<3.25$ (N·m).

The inventors have verified by experiments that the deterioration in axial tension is about 17% when a stainless steel M5 screw, which may be deteriorated in its axial tension with time or heat cycle, is used. Therefore, in order to provide the advantage of suppressing the occurrence of the intermodulation distortion for long time, the screw is preferably tightened with a torque having at least 35% added to the minimum torque required by taking the safety factor into account. Note that since the deterioration amount of the axial tension is varied according to the diameter of the screw, the material of the screw and the initial torque, the deterioration amount may be verified by experiments as appropriate, and the minimum torque required may be obtained and set.

Fifth Embodiment

Figure 8A:
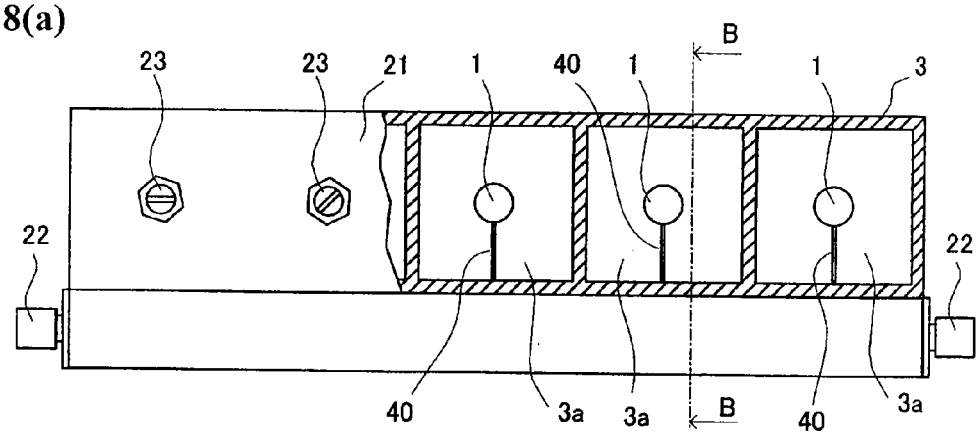
FIG. 8 is an illustration showing a configuration of a band elimination filter according to a fifth embodiment of the present invention.
Figure 8B:
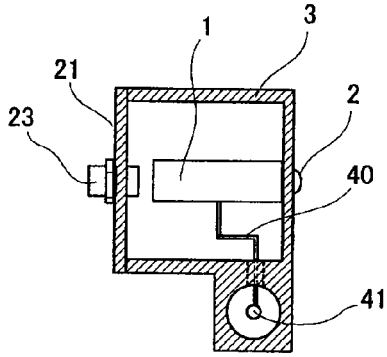

FIG. 8(*a*) is a plan view showing a band elimination filter having a plurality of semi-coaxial cavity resonators, and shows the inside of the filter with a part of the upper conductor panel 21 eliminated. FIG. 8(*b*) is a cross sectional view taken along a line B-B in FIG. 8(*a*), and shows the inside of the filter with a part of a lateral surface of the outer conductor 3 eliminated.

The outer conductor 3 has a hollow structure with a surface being opened, and the hollow structure is divided by partitions into cavities. The inner conductors 1 are fixed at the bottom surface 3*a* of the outer conductor 3 with the screws 2. The inner conductors 1 are not fixed at the undersurface of the upper conductor panel 21 which faces the bottom surface 3*a* of the outer conductor 3. Frequency-adjusting screws 23 made of a conductor are screwed through the upper conductor panel 21 at regions directly above the inner conductors 1, thereby forming five semi-coaxial cavity resonators.

A coaxial line central conductor 41 is provided between two input/output connectors 22, for coupling central conductors of the input/output connectors, and predetermined positions of the coaxial line central conductor 41 are respectively connected to the inner conductors 1 via Qe leads 40.

A node of each Qe lead relative to the coaxial line central conductor is arranged such that a distance between the nodes is substantially λ/4 (where λ is a wavelength of a central frequency of an elimination band). This structure gives band elimination characteristics.

Sixth Embodiment

Figure 9:
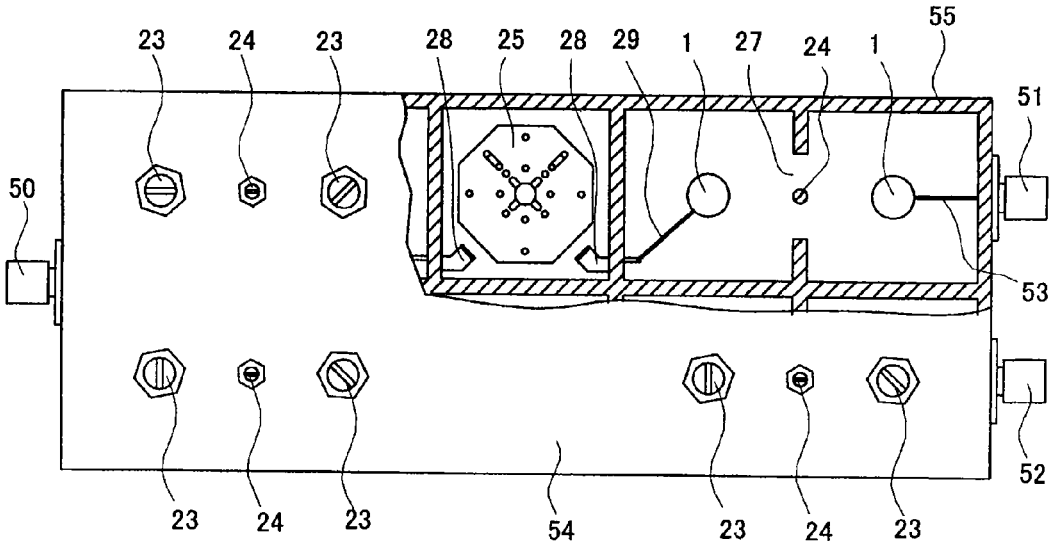
FIG. 9 is an illustration showing a configuration of a duplexer according to a sixth embodiment of the present invention.

FIG. 9 is a plan view of a duplexer in which the semi-coaxial cavity resonator and the dielectric resonator are combined, and shows the inside of the duplexer with a part of the upper conductor panel 21 eliminated.

The duplexer is configured such that two band pass filters formed as shown in FIG. 4 are combined. However, it is noted in this example that the upper band pass filter in the drawing is used as a transmission filter having a transmission input connector 51, and the lower band pass filter is used as a reception filter having a reception output connector 52. Accordingly, the center frequencies of these band pass filters are different from each other.

In addition, to combine the two filters, a casing 55 and a panel 54 are shared by the two filters. Though the panel 54 is fixed relative to the casing 55 with screws, the screws are not shown in the drawing.

An antenna connector 50 is an input connector for both transmission and reception purposes, and is used as an input unit of a reception signal to the reception filter, and as an output unit of a transmission signal from the transmission filter. The inner conductor 1 is preferably fixed to the casing 55 with a screw in a manner shown in FIG. 7, and in particular, it is preferable that four of the cavity resonators disposed close to the antenna connector 50 are all fixed at the casing 55 in a manner shown in FIG. 7.

While the transmission filter and the reception filter are 7-stage filters each having the dielectric triple-mode resonator disposed at the intermediate stage, one of the filters may have only the cavity resonators in all stages.

Seventh Embodiment

Figure 10:
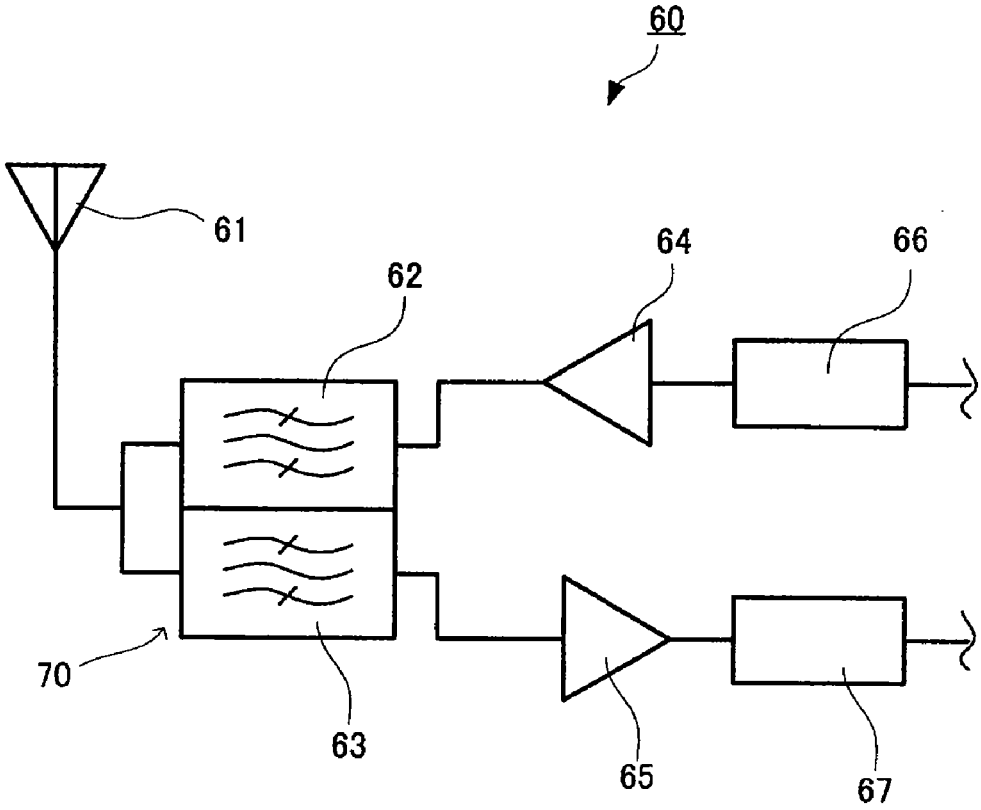
FIG. 10 is an illustration showing a configuration of a communication apparatus according to a seventh embodiment of the present invention.

FIG. 10 is a block diagram showing a configuration of a communication apparatus which is used at a mobile communication base station. A transmission filter 62 and a reception filter 63 constitute a duplexer 70. An antenna 61 is connected to an input/output unit for both transmission and reception purposes of the duplexer 70, via a cable. A PA (power amplifier) 64 is connected to an output port of a modulator 66, and an amplified signal of the power amplifier 64 is input to the transmission filter 62. In addition, a LNA (low-noise amplifier) 65 is connected to an output port of the reception filter 63, and an output signal of the LNA 65 is input to a demodulator 67. The duplexer according to the sixth embodiment is applied to the duplexer 70.

Although the present invention has been described in relation to particular embodiments thereof, many other variations and modifications and other uses will become apparent to those skilled in the art. Therefore, the present invention is not limited by the specific disclosure herein.

The invention claimed is:

1. A semi-coaxial cavity resonator comprising:

an outer conductor having a cavity therein; and a columnar inner conductor fixed at a bottom surface of the cavity, but not fixed at an upper surface facing the bottom surface of the cavity, wherein the inner conductor has a hole therein with an internal thread being formed at the hole, and is fixed at the bottom surface of the outer conductor with a screw, a surface roughness (Ra) of each of a contact surface of the inner conductor and that of the outer conductor is equal to or less than 1.6 μm;

wherein a contact pressure of $(5T/d)/S \geqq 60$ MPa is established, where S ($m^2$) is an area of the contact surface, T (N·m) is a tightening torque of the screw, and d (m) is a diameter of the screw, the hole of the inner conductor has an inner cavity that is not engaged with the screw, at a region directly above the bottom surface of the outer conductor, and a height of the inner cavity is equal to or more than a radius of the screw, and a length of a portion of the screw being engaged with the internal thread is equal to or less than twice the diameter of the screw.

2. The semi-coaxial cavity resonator according to claim 1, wherein at a portion where the bottom surface of the columnar inner conductor is fixed at the bottom surface of the cavity with the screw, a projecting portion is projected from the bottom surface of the cavity and extends around the entire circumference of a surface that is in contact with the columnar inner conductor, and the projecting portion is rounded at the entire outer circumference of the projecting portion and continuously arranged with the bottom surface.

3. A semi-coaxial cavity resonator comprising:

an outer conductor having a cavity therein; and a columnar inner conductor fixed at a bottom surface of the cavity, but not fixed at an upper surface facing the bottom surface of the cavity, wherein the inner conductor has a hole therein with an internal thread being formed at the hole, and is fixed at the bottom surface of the outer conductor with a screw, a surface roughness (Ra) of each of a contact surface of the inner conductor and that of the outer conductor is equal to or less than 1.6 μm;

wherein a contact pressure of $(5T/d)/S \geqq 60$ MPa is established, where S ($m^2$) is an area of the contact surface, T (N·m) is a tightening torque of the screw, and d (m) is a diameter of the screw, the screw has an unthreaded portion that is not engaged with the internal thread of the inner conductor, at a region directly above a bearing surface of the outer conductor, and a diameter of the unthreaded portion is equal to or less than a minor diameter of an external thread, and a length of the unthreaded portion is equal to or more than the radius of the screw, and a length of a portion of the screw being screwed with the internal thread is equal to or less than twice the diameter of the screw.

4. The semi-coaxial cavity resonator according to claim 3, wherein at a portion where the bottom surface of the columnar inner conductor is fixed at the bottom surface of the cavity with the screw, a projecting portion is projected from the bottom surface of the cavity and extends around the entire circumference of a surface that is in contact with the columnar inner conductor, and the projecting portion is rounded at the entire outer circumference of the projecting portion and continuously arranged with the bottom surface.

5. The semi-coaxial cavity resonator according to any one of claims 1 to 4, wherein the outer conductor is made of aluminum, or an aluminum alloy, and the inner conductor is made of stainless steel.

6. A band pass filter comprising: a plurality of the semi-coaxial cavity resonators according to any one of claims 1, 2, 3, and 4, the semi-coaxial cavity resonators being continuously arranged; and input/output connectors, wherein a slit having a predetermined size is provided at a partition that is disposed between the adjacent semi-coaxial cavity resonators to couple the semi-coaxial cavity resonators between stages.

7. A band elimination filter comprising: a plurality of the semi-coaxial cavity resonators according to any one of claims 1, 2, 3, and 4, the semi-coaxial cavity resonators being continuously arranged; and coupling units that allow the semi-coaxial cavity resonators to be electrically coupled to a transmission line provided with input/output connectors.

8. A duplexer comprising: at least two filters, and an antenna connector that is connected to the filters in a shared manner, wherein at least one of the filters is the band pass filter according to claim 6.

9. A communication apparatus comprising: the duplexer according to claim 8; a transmission circuit that is connected to at least one of the input/output connectors of the duplexer; and a reception circuit that is connected to another one of the input/output connectors.

10. The communication apparatus according to claim 9, further comprising an antenna that is connected to the antenna connector of the duplexer.

* * * * *